US008661740B2

(12) United States Patent
Lin

(10) Patent No.: US 8,661,740 B2
(45) Date of Patent: Mar. 4, 2014

(54) FOLDABLE SAFETY HANDRAIL ASSEMBLY

(75) Inventor: Yong-Hao Lin, Xiushui Township, Changhua County (TW)

(73) Assignee: Yo Yuh Inst. Co., Ltd., Xiushui Township, Changua County (TW)

( * ) Notice: Subject to any disclaimer, the term of this patent is extended or adjusted under 35 U.S.C. 154(b) by 619 days.

(21) Appl. No.: 12/954,208

(22) Filed: Nov. 24, 2010

(65) Prior Publication Data

US 2012/0126193 A1 May 24, 2012

(51) Int. Cl.
*E04F 11/18* (2006.01)

(52) U.S. Cl.
USPC ..... 52/29; 52/32; 52/34; 52/35; 297/411.32; 297/DIG. 10; 4/254; 248/292.13; 403/94; 403/98

(58) Field of Classification Search
USPC ..... 52/29, 32, 34, 35; 297/411.32, DIG. 10; 4/254, 604, 667; 256/67; 248/292.13; 403/93, 94, 98, 99
See application file for complete search history.

(56) References Cited

U.S. PATENT DOCUMENTS

| | | | | | |
|---|---|---|---|---|---|
| 3,398,410 | A * | 8/1968 | Sparling | ..... | 4/254 |
| 5,687,431 | A * | 11/1997 | Garrett | ..... | 4/254 |
| 5,787,515 | A * | 8/1998 | Mason et al. | ..... | 4/254 |
| 6,253,497 | B1 * | 7/2001 | Gekler et al. | ..... | 52/27 |
| 7,255,402 | B1 * | 8/2007 | Haddad et al. | ..... | 297/411.32 |
| 2002/0105217 | A1 * | 8/2002 | Khedira et al. | ..... | 297/411.32 |

FOREIGN PATENT DOCUMENTS

| | | | | | |
|---|---|---|---|---|---|
| JP | 10337312 | A * | 12/1998 | ..... | A61H 3/00 |
| JP | 2000257233 | A * | 9/2000 | ..... | E04F 11/18 |
| JP | 2001049824 | A * | 2/2001 | ..... | E04F 11/18 |
| JP | 2002095612 | A * | 4/2002 | ..... | A47K 17/02 |
| JP | 2002238806 | A * | 8/2002 | ..... | A47K 17/02 |
| JP | 2004244823 | A * | 9/2004 | ..... | E04F 11/18 |
| JP | 2004353363 | A * | 12/2004 | ..... | E04F 11/18 |
| JP | 2004353364 | A * | 12/2004 | ..... | E04F 11/18 |
| JP | 2005282014 | A * | 10/2005 | ..... | E04F 11/18 |
| JP | 2006263023 | A * | 10/2006 | | |
| JP | 2009180046 | A * | 8/2009 | | |
| JP | 2009209566 | A * | 9/2009 | | |
| JP | 2011026795 | A * | 2/2011 | | |
| JP | 2013002148 | A * | 1/2013 | | |
| JP | 2013002149 | A * | 1/2013 | | |

* cited by examiner

*Primary Examiner* — Victor MacArthur
(74) *Attorney, Agent, or Firm* — Alan Kamrath; Kamrath IP Lawfirm, P.A.

(57) ABSTRACT

A foldable safety handrail assembly includes a mounting bracket, a fixing sleeve mounted on the mounting bracket, a release sleeve mounted on the mounting bracket and having a release groove, a rail having a pivot tube which has a first locking groove and a second locking groove, a locking tube extending through the fixing sleeve, the pivot tube and the release sleeve and having a limit slot, a locking member mounted in the limit slot and detachably locked in the first locking groove or the second locking groove, a control member mounted in the locking tube to move the locking member, and a push knob mounted on and pushing the control member. Thus, the user only needs to push the push knob to unlock and fold the rail so that the rail can be unlocked and folded easily and quickly.

10 Claims, 11 Drawing Sheets

FOLDABLE SAFETY HANDRAIL ASSEMBLY

BACKGROUND OF THE INVENTION

1. Field of the Invention

The present invention relates to a handrail assembly and, more particularly, to a foldable safety handrail assembly.

2. Description of the Related Art

A conventional foldable safety handrail assembly in accordance with the prior art shown in FIGS. 10 and 11 comprises a mounting bracket 60 attached to a surface, such as a wall and the like, two support tubes 61 mounted on the mounting bracket 60 and spaced from each other, a rail 50 pivotally connected with the mounting bracket 60 and having a side provided with a pivot tube 51 which is pivotally mounted between the two support tubes 61 and has a periphery provided with a first locking hole 511, a locking tube 62 extending through the two support tubes 61 and the pivot tube 51 of the rail 50 and having a periphery provided with a second locking hole 63 aligning with the first locking hole 511 of the pivot tube 51, and an elastic plate 64 mounted in the locking tube 62 and having a side provided with a locking knob 641 extending through the second locking hole 63 of the locking tube 62 and detachably locked in the first locking hole 511 of the pivot tube 51 to releasably lock the pivot tube 51 onto the locking tube 62. The pivot tube 51 of the rail 50 has a C-shaped profile and has a surface provided with a slit 52 which has two opposite pressing plates 53. Each of the two pressing plates 53 of the pivot tube 51 is provided with a through hole 54. The conventional foldable safety handrail assembly further comprises a fastening bolt 55 extending through the through hole 54 of each of the two pressing plates 53, and a fastening nut 56 screwed onto the fastening bolt 55. Thus, the two pressing plates 53 of the pivot tube 51 are moved by the fastening bolt 55 to compress the pivot tube 51 toward the locking tube 62 so that the pivot tube 51 is locked onto the locking tube 62.

In operation, when the fastening bolt 55 is unscrewed from the fastening nut 56, the two pressing plates 53 of the pivot tube 51 are loosened to release the pivot tube 51 from the locking tube 62. Then, the locking knob 641 of the elastic plate 64 is pressed by a user to detach from the first locking hole 511 of the pivot tube 51 and to retract into the second locking hole 63 of the locking tube 62 so that the pivot tube 51 is unlocked from the locking tube 62 and can be rotated relative to the locking tube 62 to pivot and move the rail 50 relative to the mounting bracket 60 so as to fold the rail 50.

However, the user has to use a hand tool to screw or unscrew the fastening bolt 55 so as to clamp or loosen the pivot tube 51, thereby causing inconvenience to the user. In addition, the user has to press the locking knob 641 of the elastic plate 64 so as to detach the locking knob 641 of the elastic plate 64 from the first locking hole 511 of the pivot tube 51 and to retract the locking knob 641 of the elastic plate 64 into the second locking hole 63 of the locking tube 62, so that the user cannot unlock the pivot tube 51 from the locking tube 62 easily and quickly, thereby causing inconvenience to the user. Further, the elastic plate 64 will easily produce an elastic fatigue during a long-term utilization so that the elastic plate 64 is inoperative.

BRIEF SUMMARY OF THE INVENTION

In accordance with the present invention, there is provided a foldable safety handrail assembly, comprising a mounting bracket, a fixing sleeve mounted on the mounting bracket, a release sleeve mounted on the mounting bracket and having a periphery provided with a release groove, a rail pivotally connected with the mounting bracket and having a side provided with a pivot tube which is pivotally mounted between the fixing sleeve and the release sleeve and has a periphery provided with a first locking groove and a second locking groove, a locking tube extending through the fixing sleeve, the pivot tube and the release sleeve and having a periphery provided with an elongate limit slot, a locking member slidably mounted in the limit slot of the locking tube and detachably locked in the first locking groove or the second locking groove of the pivot tube to releasably lock the pivot tube onto the locking tube, a control member movably mounted in the locking tube and connected with the locking member to move the locking member, and an elastic member mounted in the locking tube and biased between the control member and the release sleeve to push the locking member toward the first locking groove or the second locking groove of the pivot tube. The control member has a first end provided with an enlarged driving head connected with the locking member to move the locking member and a second end provided with a push portion protruding outward from the locking tube. The foldable safety handrail assembly further comprises a push knob mounted on the control member to push the locking member toward the release groove of the release sleeve.

The release sleeve has a closed end portion provided with a through hole, the driving head of the control member has an end face provided with a pull portion which extends through and protrudes outward from the through hole of the release sleeve, and the foldable safety handrail assembly further comprises a pull knob fixed on the pull portion of the control member to pull the driving head of the control member toward the release sleeve and to pull the locking member toward the release groove of the release sleeve.

The primary objective of the present invention is to provide a foldable safety handrail assembly that is operated easily and conveniently.

According to the primary advantage of the present invention, the user only needs to push the push knob or pull the pull knob to unlock and fold the rail so that the rail can be unlocked and folded easily and quickly, thereby facilitating the user unlocking and folding the rail in an energy-saving manner.

According to another advantage of the present invention, the control member has a greater strength and stiffness so that the control member will not be easily deformed, worn out or broken during a long-term utilization, thereby enhancing the lifetime of the foldable safety handrail assembly.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
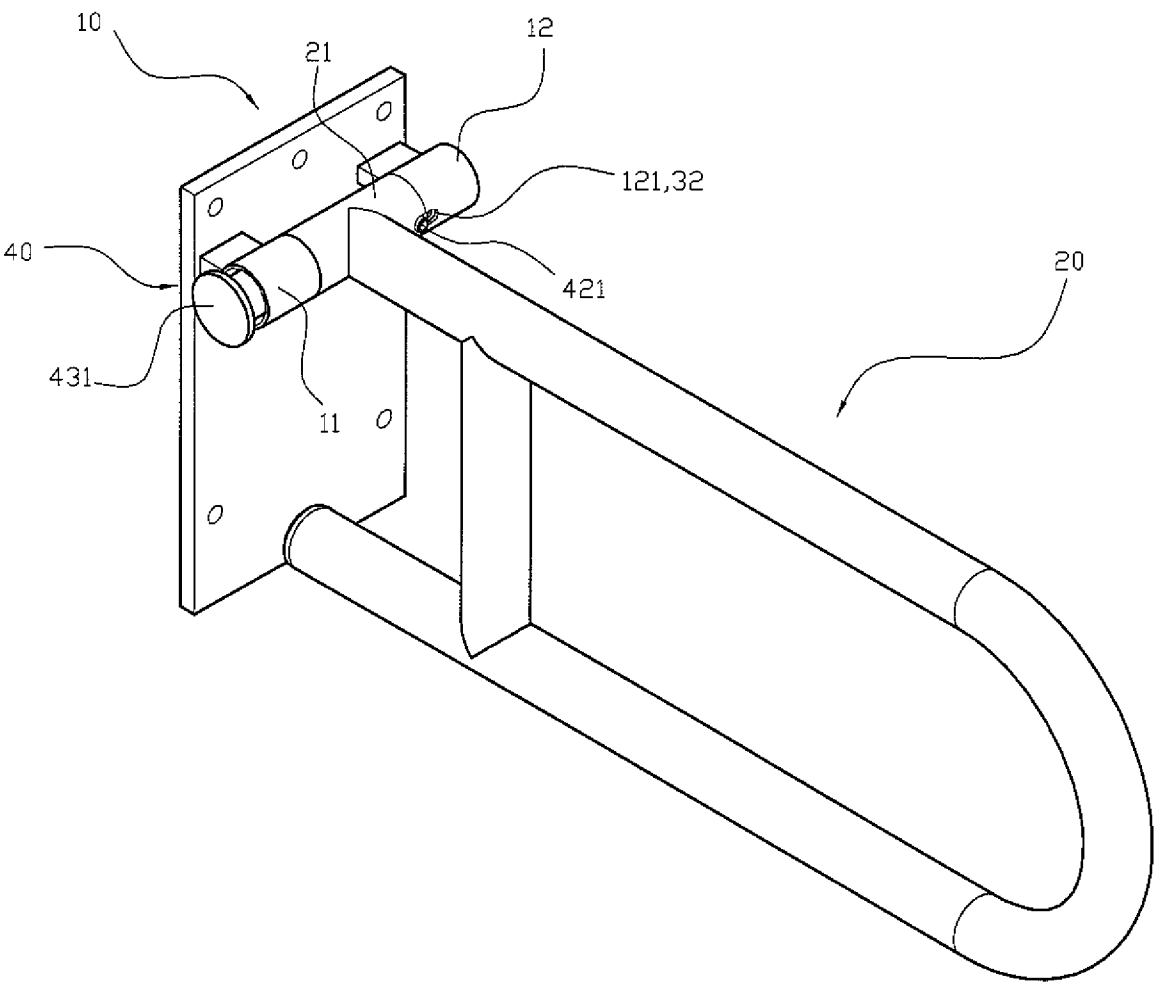
FIG. 1 is a perspective view of a foldable safety handrail assembly in accordance with the preferred embodiment of the present invention.
Figure 2:
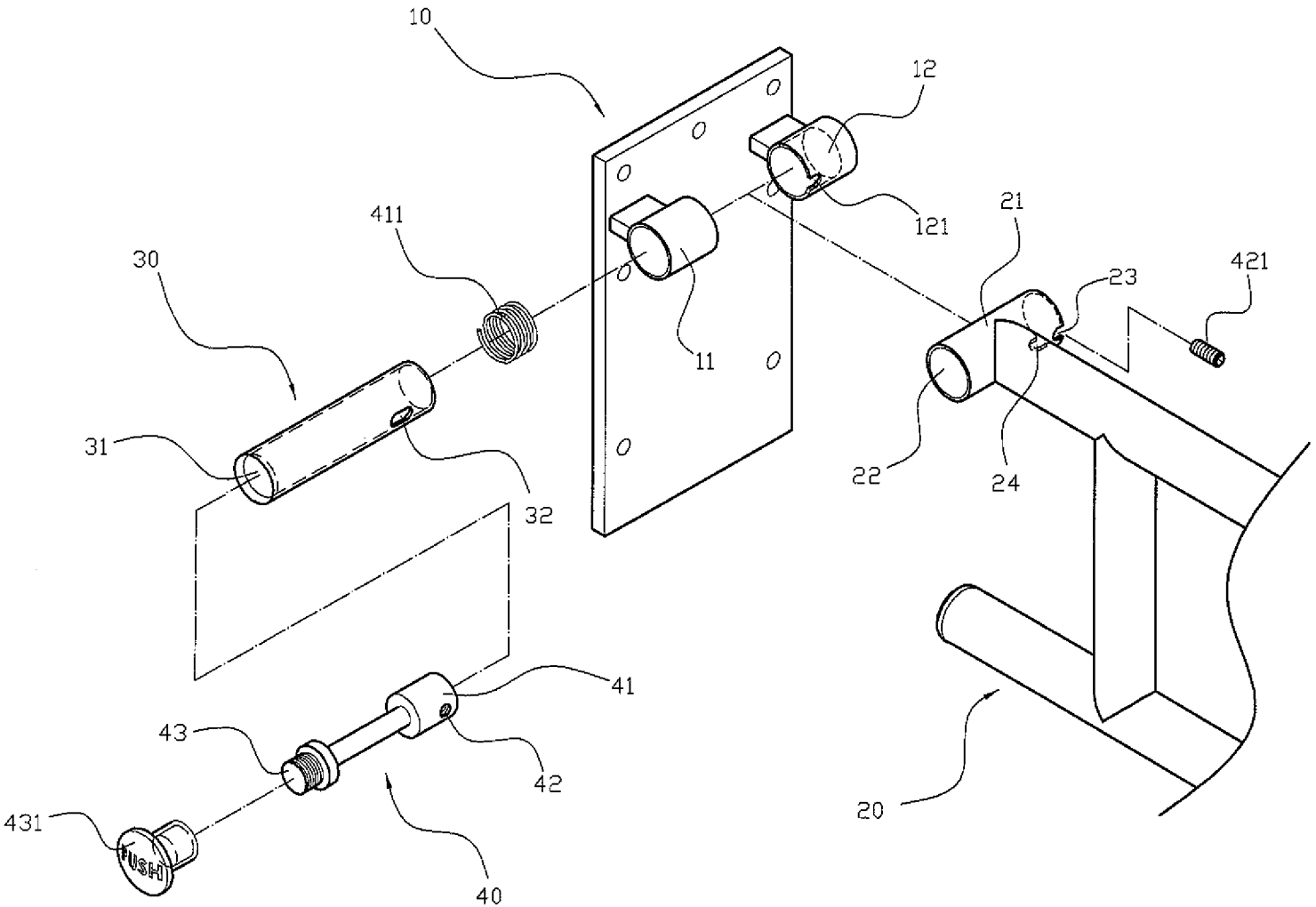
FIG. 2 is an exploded perspective view of the foldable safety handrail assembly as shown in FIG. 1.

Referring to the drawings and initially to FIGS. 1-6, a foldable safety handrail assembly in accordance with the preferred embodiment of the present invention comprises a mounting bracket 10 attached to a surface, such as a wall and the like, a fixing sleeve 11 mounted on the mounting bracket 10, a release sleeve 12 mounted on the mounting bracket 10 and having a periphery provided with a release groove 121, a rail 20 pivotally connected with the mounting bracket 10 and having a side provided with a pivot tube 21 which is pivotally mounted between the fixing sleeve 11 and the release sleeve 12 and has a periphery provided with a first locking groove 23 and a second locking groove 24, a locking tube 30 extending through the fixing sleeve 11, the pivot tube 21 and the release sleeve 12 and having a periphery provided with an elongate limit slot 32, a locking member 421 slidably mounted in the limit slot 32 of the locking tube 30 and detachably locked in the first locking groove 23 or the second locking groove 24 of the pivot tube 21 to releasably lock the pivot tube 21 onto the locking tube 30, a control member 40 movably mounted in the locking tube 30 and connected with the locking member 421 to move the locking member 421, an elastic member 411 mounted in the locking tube 30 and biased between the control member 40 and the release sleeve 12 to push the locking member 421 toward the first locking groove 23 or the second locking groove 24 of the pivot tube 21, and a push knob 431 mounted on the control member 40 to push the locking member 421 toward the release groove 121 of the release sleeve 12.

The locking tube 30 has an inner portion provided with a receiving chamber 31 to receive the control member 40 and the elastic member 411. The receiving chamber 31 of the locking tube 30 is connected to the limit slot 32. The locking tube 30 is fixed in the fixing sleeve 11 so that the locking tube 30 will not be rotated relative to the pivot tube 21 of the rail 20. Preferably, the locking tube 30 is fixed in the fixing sleeve 11 by soldering or high frequency welding. The limit slot 32 of the locking tube 30 is aligned with the release groove 121 of the release sleeve 12.

The pivot tube 21 of the rail 20 has an inner portion provided with a mounting hole 22 rotatably mounted on the locking tube 30. The mounting hole 22 of the pivot tube 21 is connected to the first locking groove 23 and the second locking groove 24. The first locking groove 23 of the pivot tube 21 is movable to align with the limit slot 32 of the locking tube 30 and the release groove 121 of the release sleeve 12, and the second locking groove 24 of the pivot tube 21 is movable to align with the limit slot 32 of the locking tube 30 and the release groove 121 of the release sleeve 12.

The control member 40 is movable in the receiving chamber 31 of the locking tube 30 and has a first end provided with an enlarged driving head 41 connected with the locking member 421 to move the locking member 421 and a second end provided with a push portion 43 protruding outward from the locking tube 30. The driving head 41 of the control member 40 has a periphery provided with a fixing hole 42 aligning with the limit slot 32 of the locking tube 30 for fixing the locking member 421 so that the locking member 421 is movable in concert with the driving head 41 of the control member 40.

The push knob 431 is fixed on the push portion 43 of the control member 40 by screwing to push the driving head 41 of the control member 40 toward the release sleeve 12 and to push the locking member 421 toward the release groove 121 of the release sleeve 12. The push knob 431 is located outside of the fixing sleeve 11.

The locking member 421 is movable in the limit slot 32 of the locking tube 30 and is movable between the release groove 121 of the release sleeve 12 and the first locking groove 23 or the second locking groove 24 of the pivot tube 21. The locking member 421 has a first end fixed in the fixing hole 42 of the driving head 41, a mediate portion movable in the limit slot 32 of the locking tube 30 and a second end extendable between the release groove 121 of the release sleeve 12 and the first locking groove 23 or the second locking groove 24 of the pivot tube 21.

The elastic member 411 is received in the receiving chamber 31 of the locking tube 30 and is biased between the driving head 41 of the control member 40 and the release sleeve 12.

Figure 3:
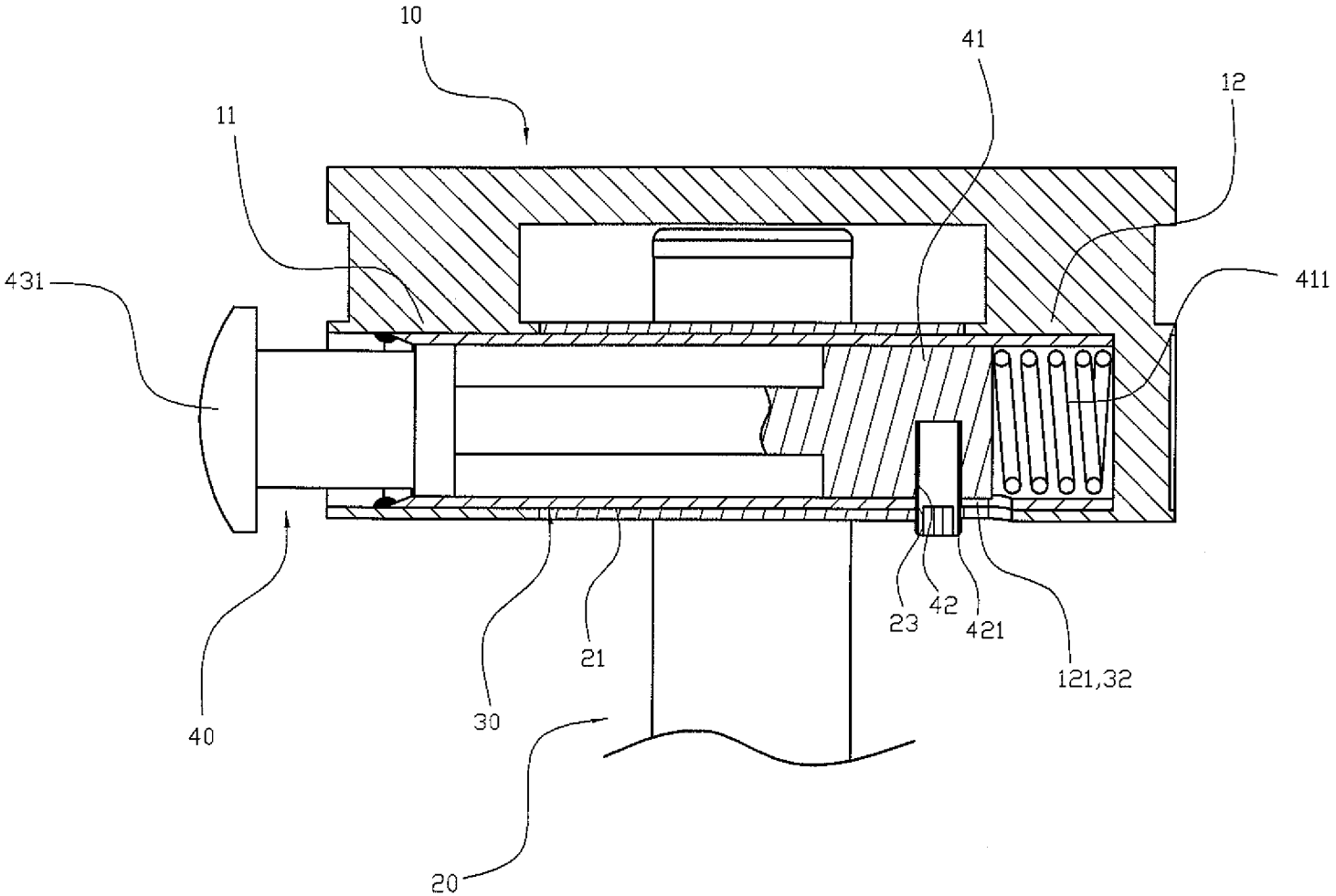
FIG. 3 is a partially top cross-sectional view of the foldable safety handrail assembly as shown in FIG. 1.
Figure 4:
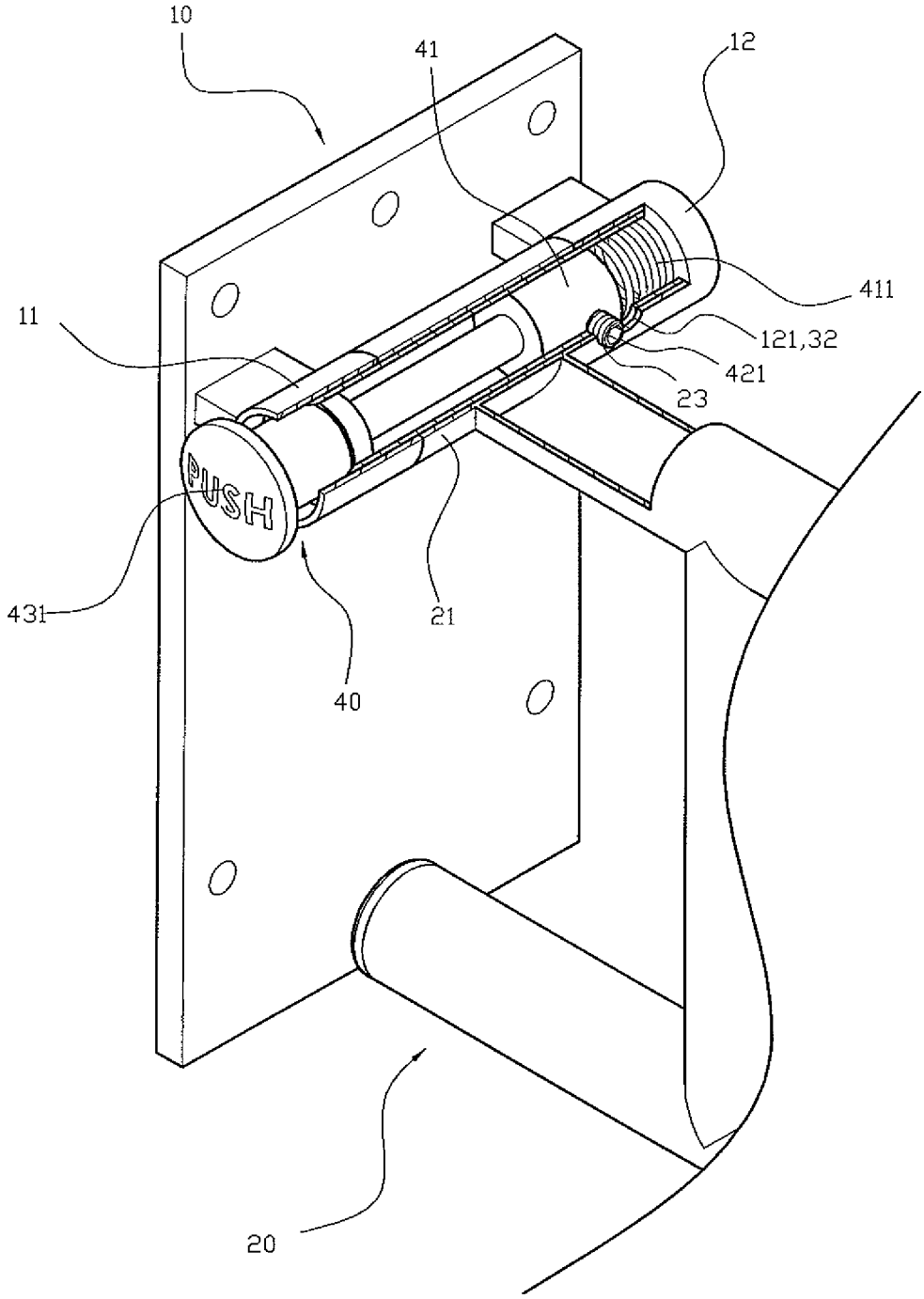
FIG. 4 is a partially perspective cross-sectional view of the foldable safety handrail assembly as shown in FIG. 1.
Figure 5:
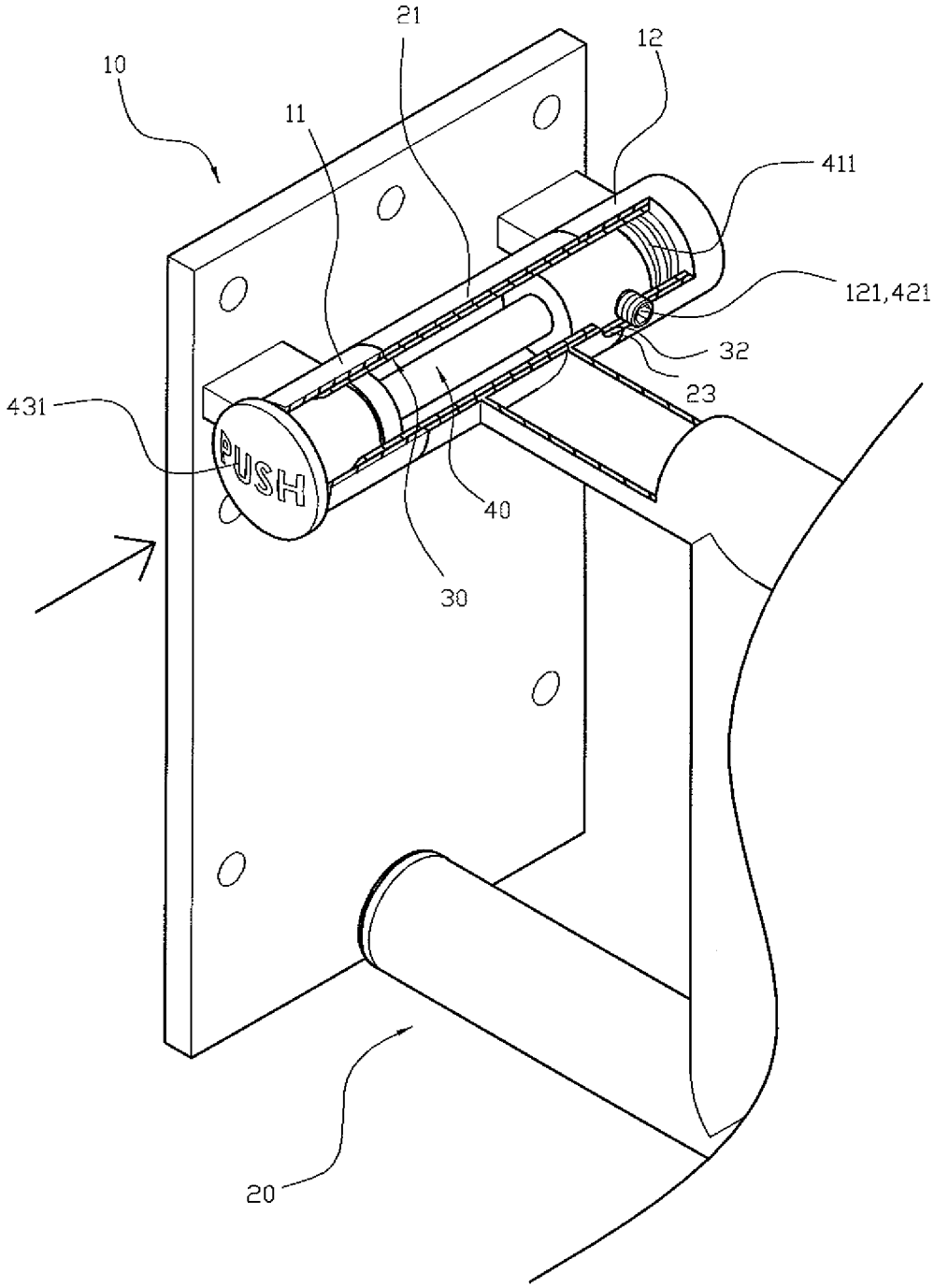
FIG. 5 is a schematic operational view of the foldable safety handrail assembly as shown in FIG. 4.
Figure 6:
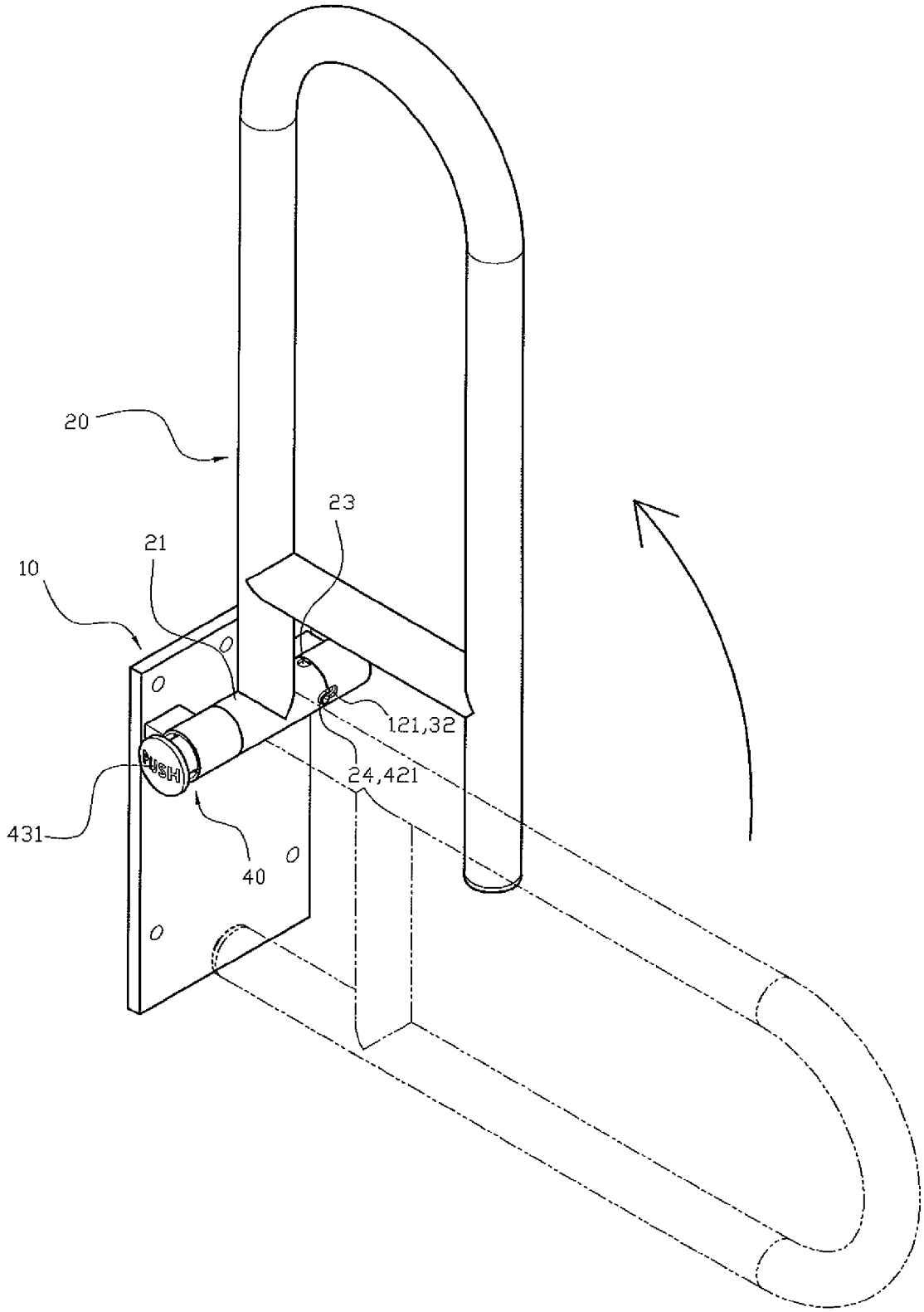
FIG. 6 is a schematic operational view of the foldable safety handrail assembly as shown in FIG. 1.

In operation, referring to FIGS. 5 and 6 with reference to FIGS. 1-4, the locking member 421 is initially locked in the first locking groove 23 of the pivot tube 21 as shown in FIGS. 3 and 4 to lock the pivot tube 21 onto the locking tube 30 so that the rail 20 is locked onto the mounting bracket 10 as shown in FIG. 1. When the push knob 431 is pressed by a user, the control member 40 is pushed toward the release sleeve 12 to compress the elastic member 411, and the locking member 421 is moved to detach from the first locking groove 23 of the pivot tube 21 and is inserted into and received in the release groove 121 of the release sleeve 12 as shown in FIG. 5, so that the pivot tube 21 is unlocked from and can be rotated relative to the locking tube 30 to pivot and move the rail 20 relative to the mounting bracket 10 so as to fold the rail 20. When the second locking groove 24 of the pivot tube 21 is moved to align with the release groove 121 of the release sleeve 12, the control member 40 is pushed toward pivot tube 21 by the restoring force of the elastic member 411, and the locking member 421 is moved to detach from the release groove 121 of the release sleeve 12 and is inserted into and locked in the second locking groove 24 of the pivot tube 21 as shown in FIG. 6 to lock the pivot tube 21 onto the locking tube 30 so that the rail 20 is locked onto the mounting bracket 10 again.

Figure 7:
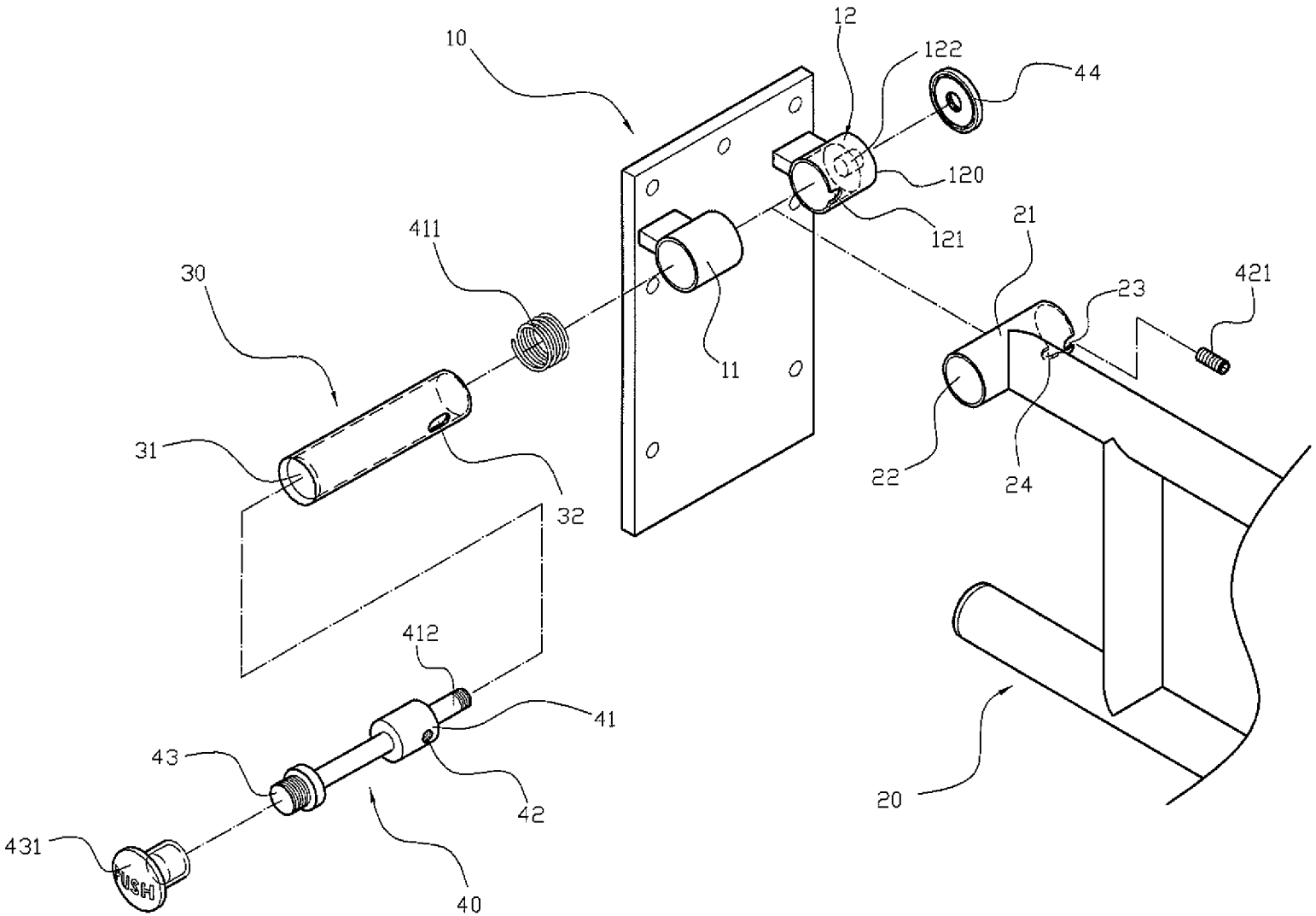
FIG. 7 is an exploded perspective view of a foldable safety handrail assembly in accordance with another preferred embodiment of the present invention.
Figure 8:
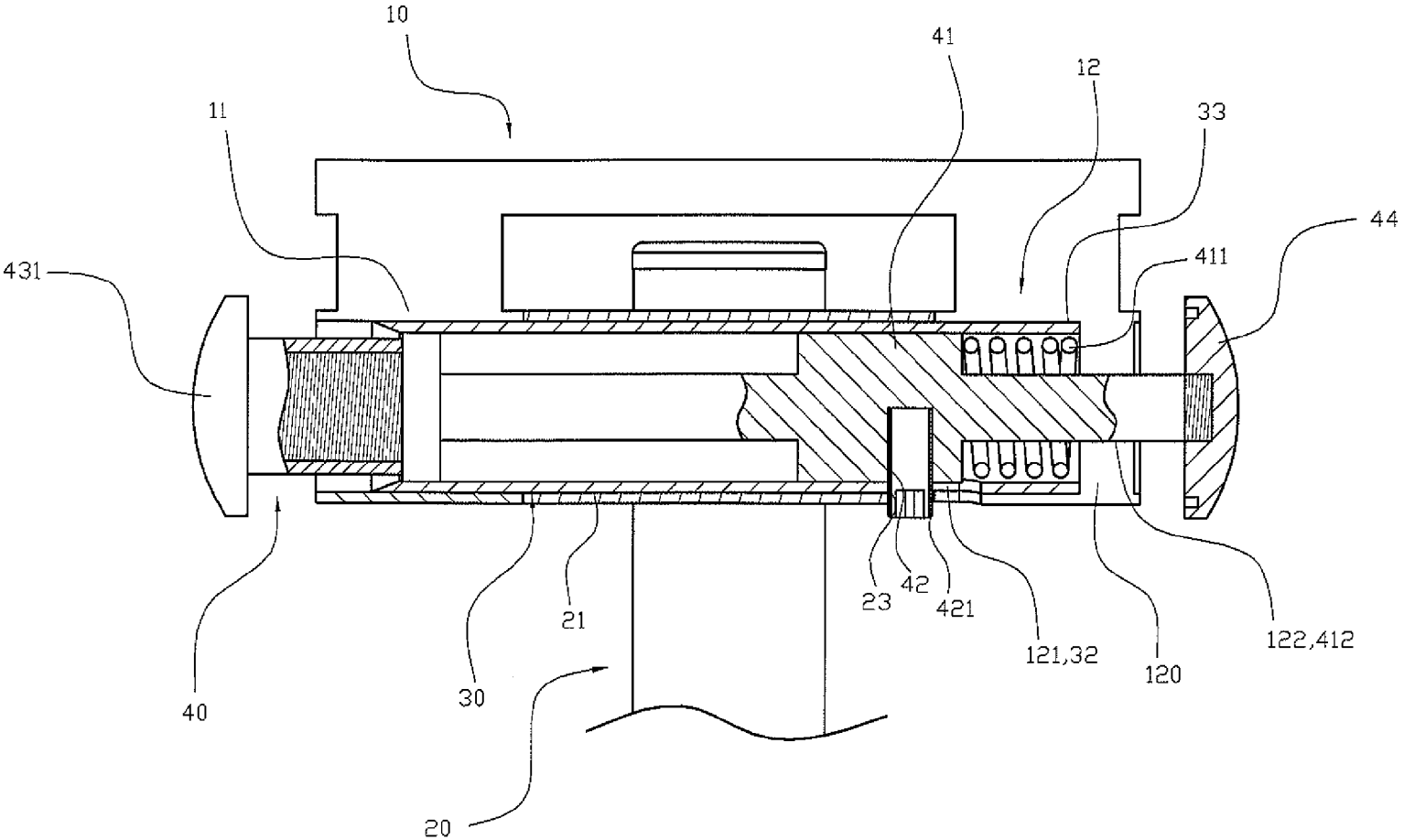
FIG. 8 is a partially top cross-sectional assembly view of the foldable safety handrail assembly as shown in FIG. 7.
Figure 9:
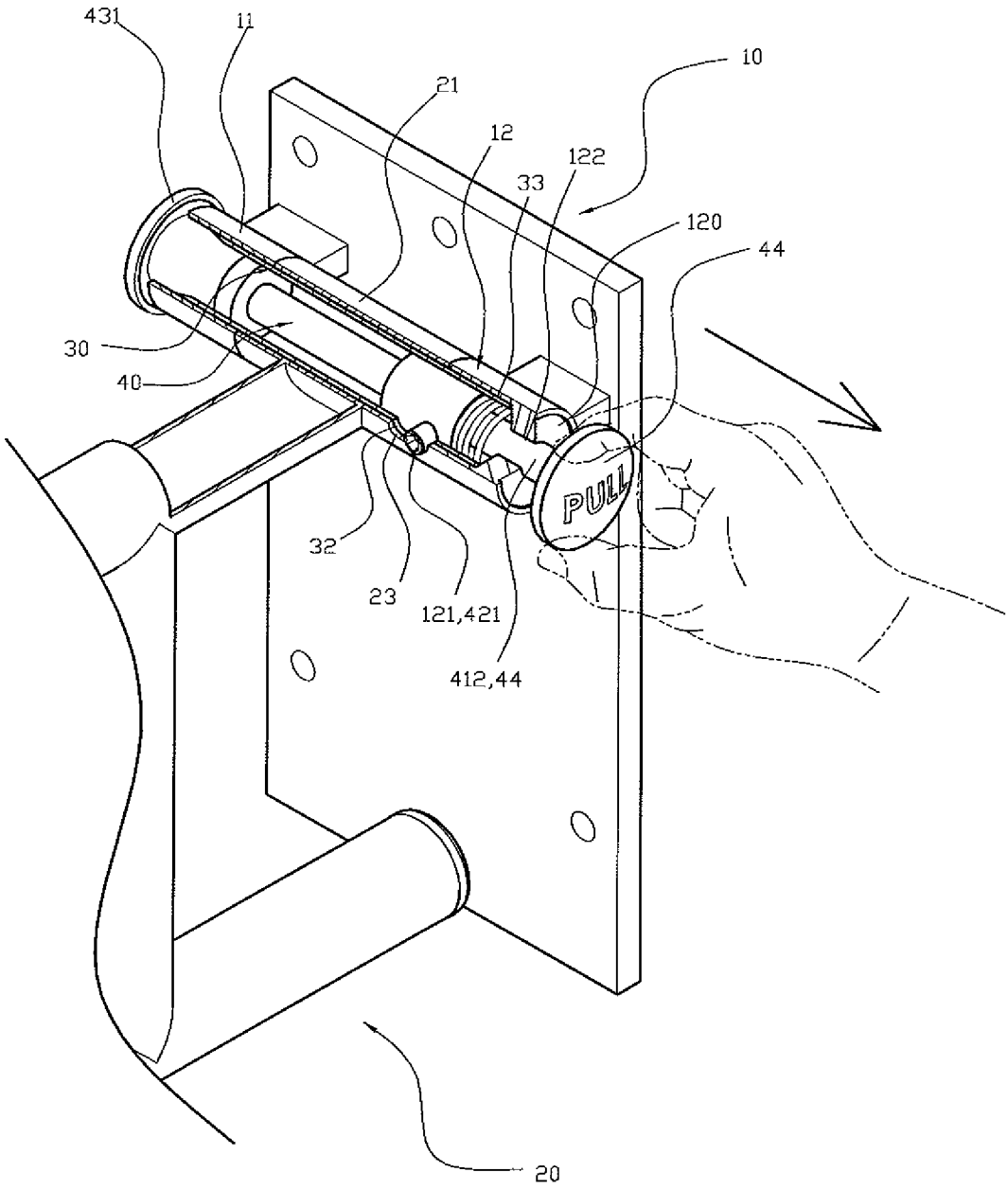
FIG. 9 is a perspective cross-sectional assembly operational view of the foldable safety handrail assembly as shown in FIG. 7.
Figure 10:
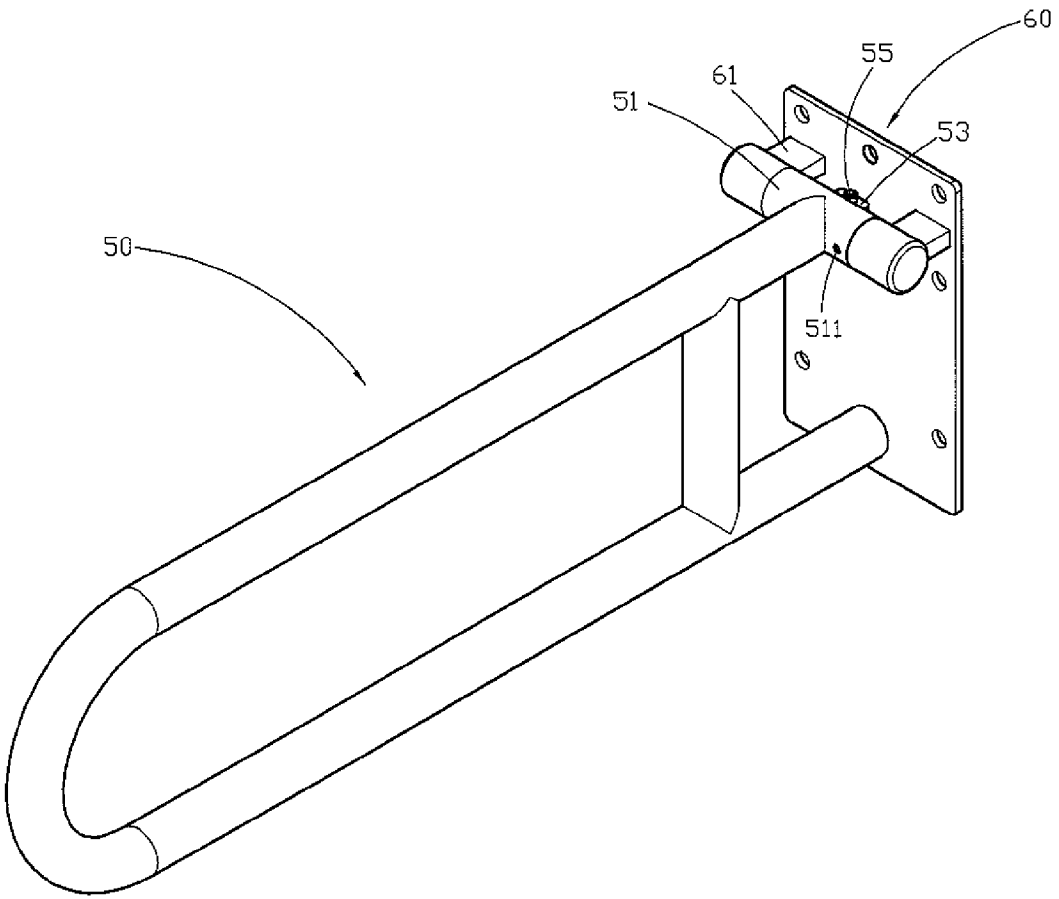
FIG. 10 PRIOR ART
FIG. 10 is a perspective view of a conventional foldable safety handrail assembly in accordance with the prior art.
Figure 11:
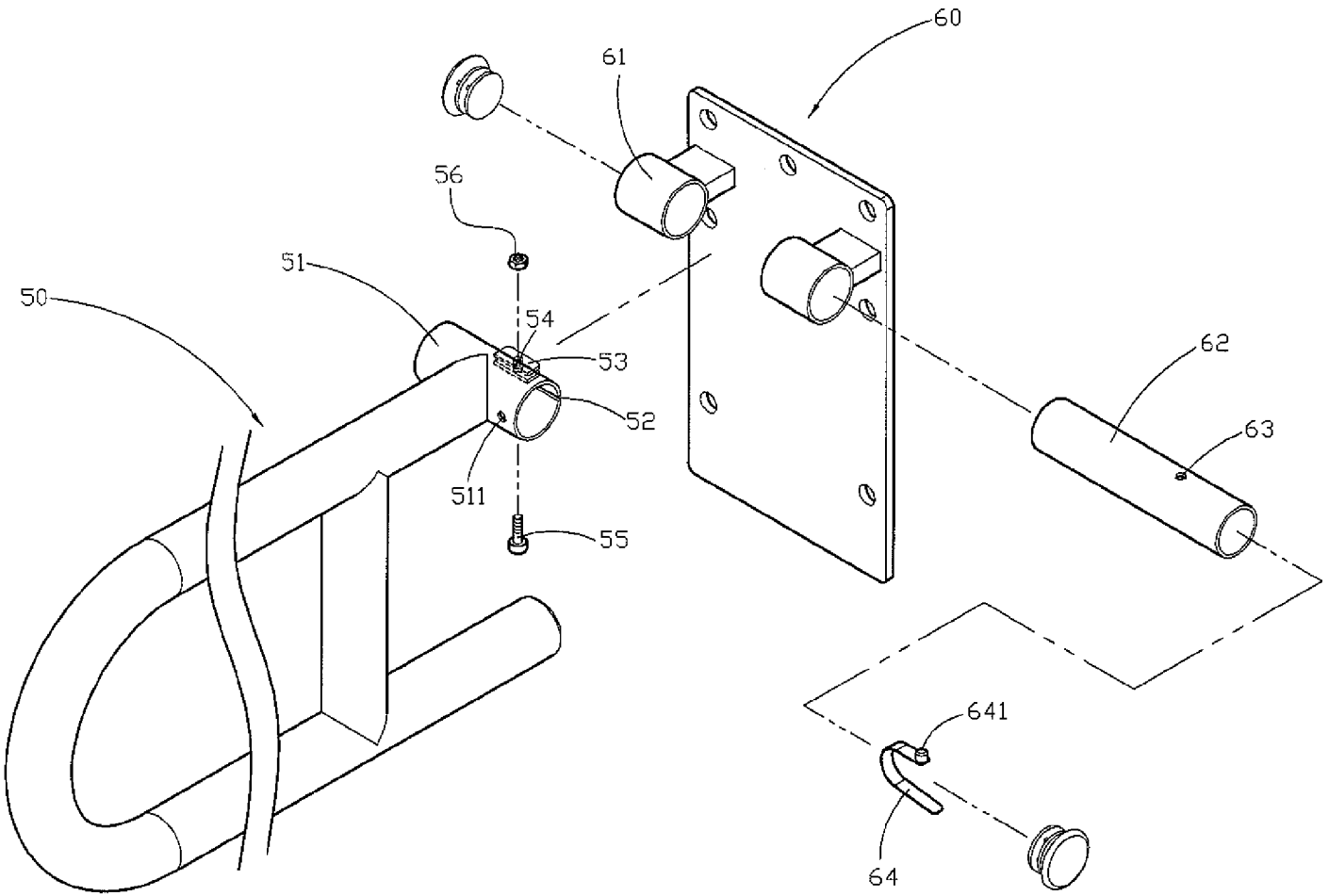
FIG. 11 PRIOR ART
FIG. 11 is an exploded perspective view of the conventional foldable safety handrail assembly as shown in FIG. 10.

Referring to FIGS. 7-9, the release sleeve 12 has a closed end portion 120 provided with a through hole 122, the driving head 41 of the control member 40 has an end face provided with a pull portion 412 which extends through and protrudes outward from the through hole 122 of the release sleeve 12, and the foldable safety handrail assembly further comprises a pull knob 44 fixed on the pull portion 412 of the control member 40 by screwing to pull the driving head 41 of the control member 40 toward the release sleeve 12 and to pull the locking member 421 toward the release groove 121 of the release sleeve 12. The pull knob 44 is located outside of the release sleeve 12. The locking tube 30 has an end portion 33 abutting the closed end portion 120 of the release sleeve 12. The elastic member 411 is mounted on the pull portion 412 of the control member 40 and is biased between the driving head 41 of the control member 40 and the closed end portion 120 of the release sleeve 12. Thus, when the pull portion 412 of the control member 40 is pulled by the pull knob 44, the driving head 41 of the control member 40 is pulled toward the release sleeve 12, and the locking member 421 is moved to detach from the first locking groove 23 of the pivot tube 21 and is inserted into and received in the release groove 121 of the release sleeve 12 as shown in FIG. 9, so that the pivot tube 21 is unlocked from and can be rotated relative to the locking tube 30 to pivot and move the rail 20 relative to the mounting bracket 10 so as to fold the rail 20.

Accordingly, the user only needs to push the push knob 431 or pull the pull knob 44 to unlock and fold the rail 20 so that the rail 20 can be unlocked and folded easily and quickly, thereby facilitating the user unlocking and folding the rail 20 in an energy-saving manner. In addition, the control member 40 has a greater strength and stiffness so that the control member 40 will not be easily deformed, worn out or broken during a long-term utilization, thereby enhancing the lifetime of the foldable safety handrail assembly.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A foldable safety handrail assembly, comprising:

a mounting bracket;

a fixing sleeve mounted on the mounting bracket;

a release sleeve mounted on the mounting bracket and having a periphery provided with a release groove;

a rail pivotally connected with the mounting bracket and having a side provided with a pivot tube which is pivotally mounted between the fixing sleeve and the release sleeve and has a periphery provided with a first locking groove and a second locking groove;

a locking tube extending through the fixing sleeve, the pivot tube and the release sleeve and having a periphery provided with an elongate limit slot;

a locking member slidably mounted in the limit slot of the locking tube and detachably locked in the first locking groove or the second locking groove of the pivot tube to releasably lock the pivot tube onto the locking tube;

a control member movably mounted in the locking tube and connected with the locking member to move the locking member; and an elastic member mounted in the locking tube and biased between the control member and the release sleeve to push the locking member toward the first locking groove or the second locking groove of the pivot tube;

wherein the control member has a first end provided with an enlarged driving head connected with the locking member to move the locking member and a second end provided with a push portion protruding outward from the locking tube.

2. The foldable safety handrail assembly of claim 1, wherein the foldable safety handrail assembly further comprises:

a push knob mounted on the control member to push the locking member toward the release groove of the release sleeve.

3. The foldable safety handrail assembly of claim 2, wherein the push knob is fixed on the push portion of the control member by screwing to push the driving head of the control member toward the release sleeve and to push the locking member toward the release groove of the release sleeve;

the push knob is located outside of the fixing sleeve.

4. The foldable safety handrail assembly of claim 1, wherein the release sleeve has a closed end portion provided with a through hole;

the driving head of the control member has an end face provided with a pull portion which extends through and protrudes outward from the through hole of the release sleeve; and the foldable safety handrail assembly further comprises:

a pull knob fixed on the pull portion of the control member to pull the driving head of the control member toward the release sleeve and to pull the locking member toward the release groove of the release sleeve.

5. The foldable safety handrail assembly of claim 4, wherein the locking tube has an end portion abutting the closed end portion of the release sleeve;

the elastic member is mounted on the pull portion of the control member;

the elastic member is biased between the driving head of the control member and the closed end portion of the release sleeve.

6. The foldable safety handrail assembly of claim 4, wherein the pull knob is located outside of the release sleeve.

7. The foldable safety handrail assembly of claim 1, wherein the locking tube has an inner portion provided with a receiving chamber to receive the control member and the elastic member;

the receiving chamber of the locking tube is connected to the limit slot;

the locking tube is fixed in the fixing sleeve so that the locking tube is non-rotatable relative to the pivot tube of the rail;

the locking tube is fixed in the fixing sleeve by soldering or high frequency welding;

the limit slot of the locking tube is aligned with the release groove of the release sleeve;

the control member is movable in the receiving chamber of the locking tube;

the elastic member is received in the receiving chamber of the locking tube and is biased between the driving head of the control member and the release sleeve.

8. The foldable safety handrail assembly of claim 1, wherein the pivot tube of the rail has an inner portion provided with a mounting hole rotatably mounted on the locking tube;

the mounting hole of the pivot tube is connected to the first locking groove and the second locking groove;

the first locking groove of the pivot tube is movable to align with the limit slot of the locking tube and the release groove of the release sleeve; and the second locking groove of the pivot tube is movable to align with the limit slot of the locking tube and the release groove of the release sleeve.

9. The foldable safety handrail assembly of claim 1, wherein the driving head of the control member has a periphery provided with a fixing hole aligning with the limit slot of the locking tube for fixing the locking member;

the locking member is movable in concert with the driving head of the control member;

the locking member is movable in the limit slot of the locking tube;

the locking member is movable between the release groove of the release sleeve and the first locking groove or the second locking groove of the pivot tube.

10. The foldable safety handrail assembly of claim 9, wherein the locking member has a first end fixed in the fixing hole of the driving head, a mediate portion movable in the limit slot of the locking tube and a second end extendable between the release groove of the release sleeve and the first locking groove or the second locking groove of the pivot tube.

* * * * *